US008844653B2

(12) United States Patent
deBoer

(10) Patent No.: US 8,844,653 B2
(45) Date of Patent: Sep. 30, 2014

(54) CONTINUOUS CIRCULATING SUB FOR DRILL STRINGS

(75) Inventor: Luc deBoer, Richmond, TX (US)

(73) Assignee: Dual Gradient Systems, LLC, Richmond, TX (US)

( * ) Notice: Subject to any disclaimer, the term of this patent is extended or adjusted under 35 U.S.C. 154(b) by 524 days.

(21) Appl. No.: 13/162,354

(22) Filed: Jun. 16, 2011

(65) Prior Publication Data

US 2011/0308860 A1 Dec. 22, 2011

Related U.S. Application Data

(60) Provisional application No. 61/356,441, filed on Jun. 18, 2010.

(51) Int. Cl.
*E21B 21/10* (2006.01)
*E21B 19/16* (2006.01)
*E21B 17/00* (2006.01)

(52) U.S. Cl.
CPC ..... *E21B 21/106* (2013.01); *E21B 19/16* (2013.01); *E21B 17/00* (2013.01)
USPC ..... 175/218; 166/334.4

(58) Field of Classification Search
USPC ..... 166/319, 332.3, 334.2, 334.4; 175/207, 175/218
See application file for complete search history.

(56) References Cited

U.S. PATENT DOCUMENTS

| | | | | |
|---|---|---|---|---|
| 3,123,157 | A | 3/1964 | Graham | |
| 6,119,772 | A | 9/2000 | Pruet | |
| 2009/0025930 | A1 | 1/2009 | Iblings et al. | |
| 2010/0096190 | A1 | 4/2010 | Younger et al. | |
| 2010/0155143 | A1 * | 6/2010 | Braddick | 175/218 |
| 2011/0155379 | A1 * | 6/2011 | Bailey et al. | 166/324 |

OTHER PUBLICATIONS

International Search Report and Written Opinion of the International Searching Authority, PCT/US2011/040829, dated Nov. 2, 2011, ISA/US Commissioner for Patents, P.O. Box 1450, Alexandria, Virginia 22313-1450, 7 pages.

* cited by examiner

*Primary Examiner* — Brad Harcourt
(74) *Attorney, Agent, or Firm* — Haynes and Boone, LLP

(57) ABSTRACT

A system and method for maintaining continuous flow through a drill string during drill pipe connection includes establishing drilling fluid flow axially through the length of a tubular sub attached to the top of a drill string. The sub is then engaged with a collar disposed at least partially around the perimeter of the sub so as to define an exterior flow path along the exterior of the sub. Radial flow is then initiated into the sub through said collar and along said exterior flow path. Axial flow is then terminated through the length of the tubular sub while maintaining radial flow into the sub. A pipe joint is then attached to the top of the tubular sub, axial flow is reestablished through the length of the tubular sub, radial flow is terminated into the sub, and the collar is disengaged from the sub.

31 Claims, 8 Drawing Sheets

CONTINUOUS CIRCULATING SUB FOR DRILL STRINGS

CROSS REFERENCE

The present application claims priority to U.S. Provisional Application Ser. No. 61/356,441, filed on Jun. 18, 2010, the disclosure of which is incorporated herein by reference in its entirety.

BACKGROUND

In the drilling of oil and gas wells, drilling fluid such as, for example, a variety of drilling muds known in the art, is conventionally pumped through the drill string via a connection at the top of the drill string in order to circulate the drilling fluid through the drill string during drilling operations. The drilling fluid is typically held in drilling fluid tanks or reservoirs and pumped from a stand pipe to a Kelly drive or top drive, which in turn is connected to the top of the drill string. As drilling progresses during the drilling process, portions of drill pipe are added (e.g., as 90 ft stands, 30 ft individual pipe sections, and/or a variety of other drill string sizes known in the art) between the top drive and the drill string in order to extend the drill string into the formation. Each time a drill string connection (also known as a "hook") must be made, the circulation of drilling fluid must be stopped. Conventionally, drill string connections are made by shutting down the pumps used to circulate the drilling mud before making the drill string connection, disconnecting the Kelly drive or top drive from the drill string, and connecting a stand or pipe section to the drill string. With the drill string connection made, the Kelly drive or top drive may be reconnected to the new stand or pipe section and the pumps restarted to again circulate the drilling fluid through the drill string. With the drilling fluid again circulating through the drill string, drilling operation may then continue.

One drawback to the method of the prior art is the loss of equivalent circulating density (ECD) during a hook. ECD is the effective density exerted by a circulating fluid against the formation, taking into account the mud density and the pressure drop in the annulus at a given point in the annulus. In other words, when mud is being circulated, because of friction in the annulus as the mud is pumped, there is an increase in bottomhole pressure. This pressure is significantly higher than when the mud is not being pumped. The ECD is an important parameter for drilling operations because loss or a drop in ECD can result in kicks and losses in the annulus.

The need to stop drilling fluid circulation in the drill string in order to make drill string connections is time consuming and disruptive to drilling operations. Therefore, what is needed is an improved system and method for circulating drilling fluid.

SUMMARY OF THE INVENTION

The present disclosure provides a system and method for maintaining continuous flow through a drill string during drill pipe connection. The system provides a continuous circulation sub having an elongated sub housing with an internal flow path formed in the interior of the housing between first and second ends. A flow port is formed in the housing wall between the first and second ends. The ends of the housing are preferably threaded so that the housing can be attached to drill pipe. A sleeve is slidingly disposed in the interior of the sub housing, and is axially movable from a closed position in which the flow port is blocked, to an open position, in which the flow port is in communication with the internal flow path. The sleeve has a pressure surface defined on it so that fluid pressure applied to the pressure surface will urge the sleeve from the closed position to the open position. A biasing member is provided to urge the valve sleeve to the closed position. Finally, a valve is disposed along the internal flow path, wherein the valve is movable between a first position so as to permit flow along the flow path between said first and second ends of the sub housing and a second position in which flow between the two ends is interrupted. When the sleeve is in the closed position, the valve is in the first position so that mud flows between the first and second ends. When the sleeve is in the open position, the valve is in the second position such that mud flow in through the sub can be maintained during a hook to the first end.

The method includes establishing drilling fluid flow axially through the length of a tubular sub attached to the top of a drill string, engaging said sub with a collar disposed at least partially around the perimeter of said sub so as to define an exterior flow path along the exterior of said sub, initiating radial flow into said sub through said collar and along said exterior flow path, terminating axial flow through the length of the tubular sub while maintaining radial flow into said sub, attaching a pipe joint to the top of the tubular sub, reestablishing axial flow through the length of the tubular sub, terminating radial flow into said sub, and disengaging said collar from said sub.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DESCRIPTION OF THE PREFERRED EMBODIMENTS

In the detailed description of the invention, like numerals are employed to designate like parts throughout. Various items of equipment, such as fasteners, fittings, etc., may be omitted to simplify the description. However, those skilled in the art will realize that such conventional equipment can be employed as desired.

Figure 1A:
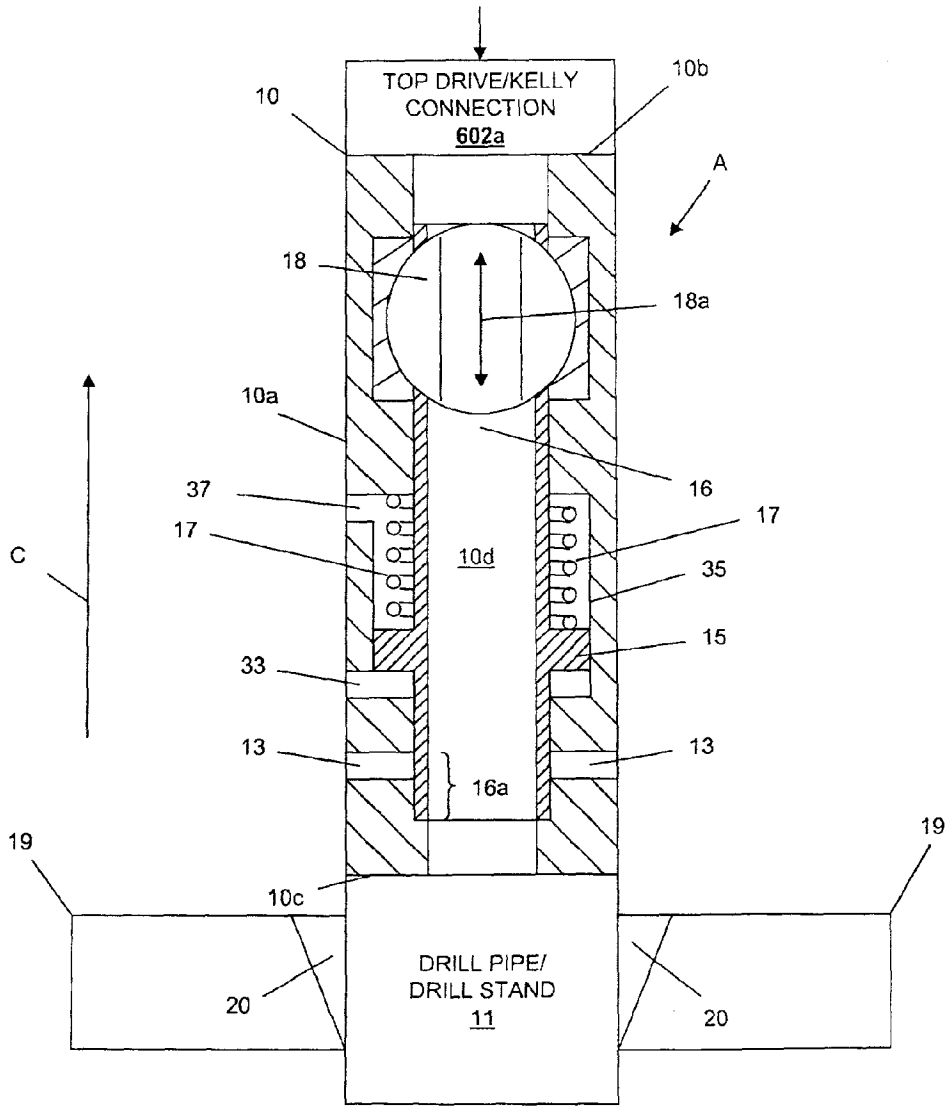
FIG. 1*a* is a cross-sectional view illustrating one embodiment of a continuous circulation sub in a top circulation mode.
Figure 1B:
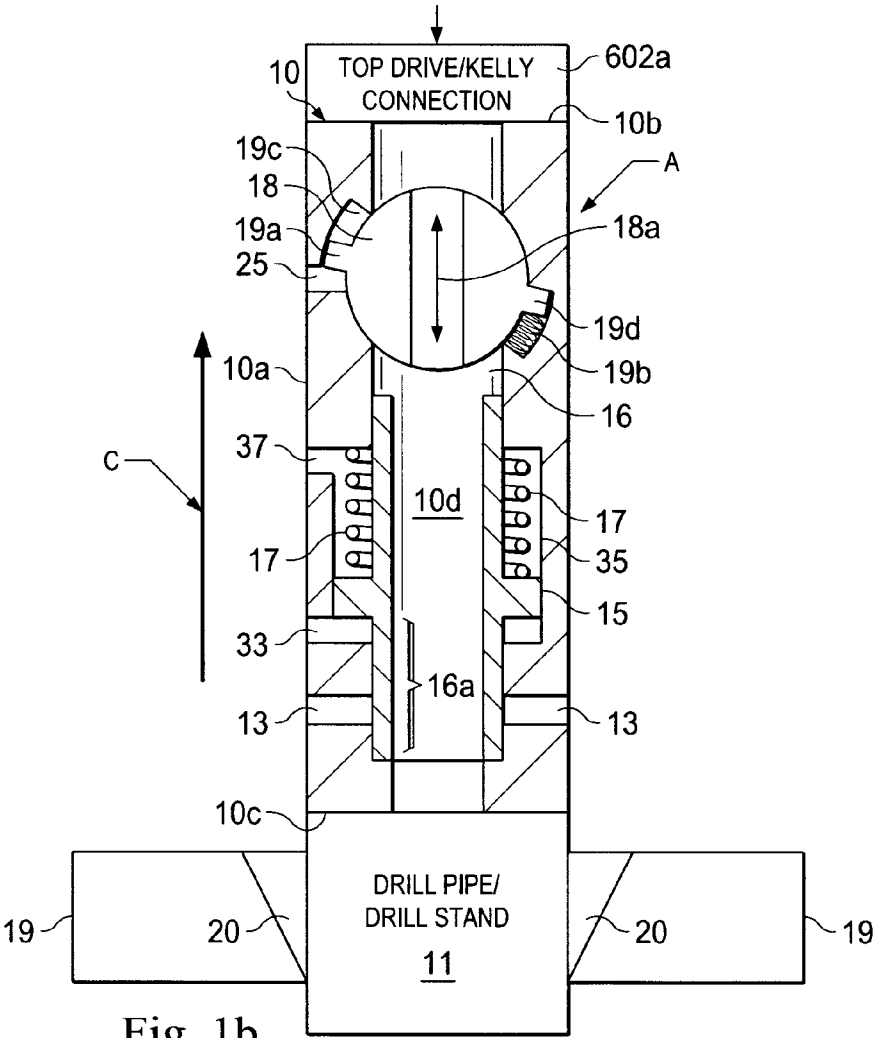
FIG. 1*b* is a cross-sectional view illustrating one embodiment of a continuous circulation sub in a top circulation mode.
Figure 2:
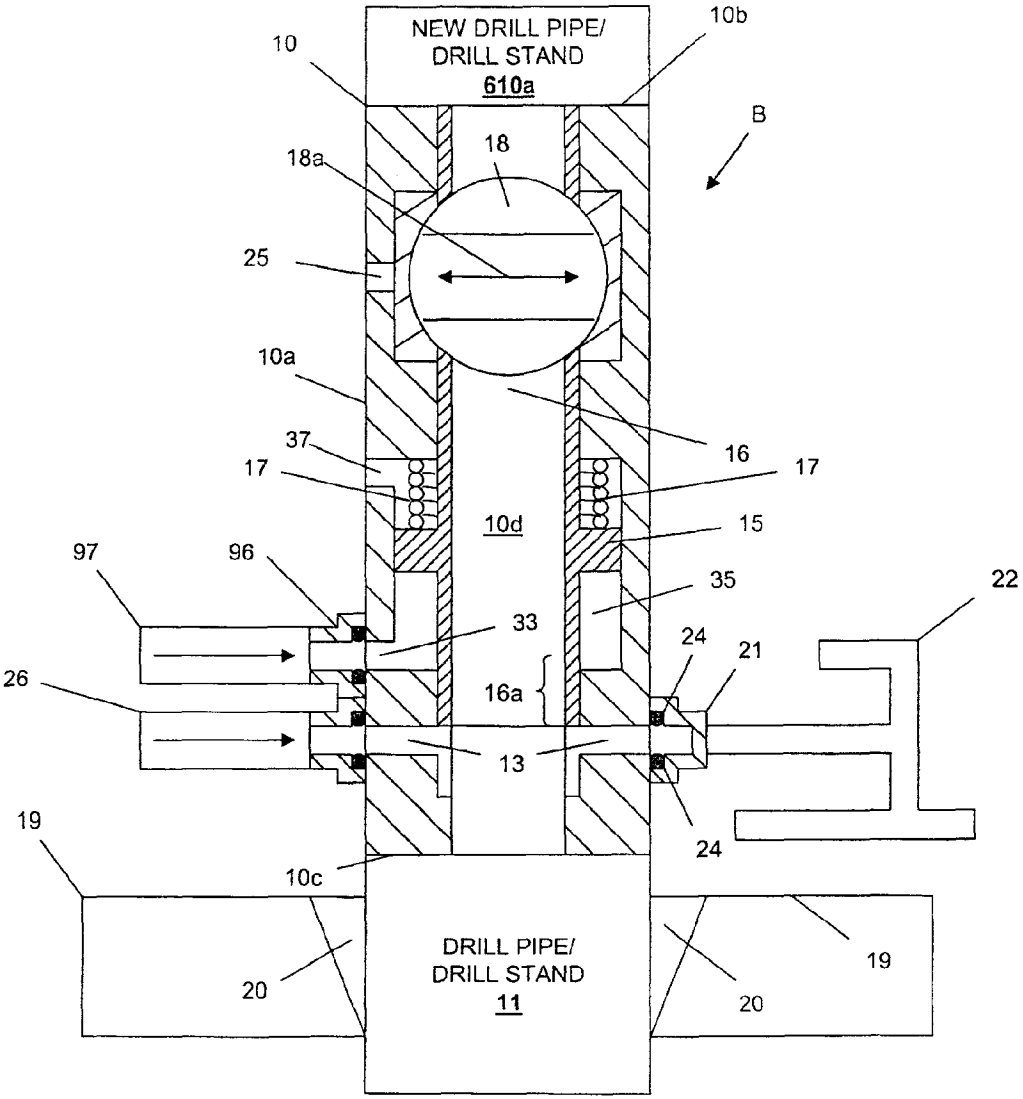
FIG. 2 is a cross-sectional view illustrating one embodiment of the continuous circulation sub in a drill string connection/hook circulation mode.

Referring now to FIGS. 1 and 2, one embodiment of a continuous circulation sub (CCS) 10 is illustrated. The CCS of the present disclosure provides for the continuous circulation of drilling fluid (e.g., drilling mud) through a drill string while making drill string connections/hooks on a rig floor. The continuous circulation of drilling fluid through a drill string allows the ECD to be maintained in the drill string annulus during a drill string connection or hook.

Figure 3:
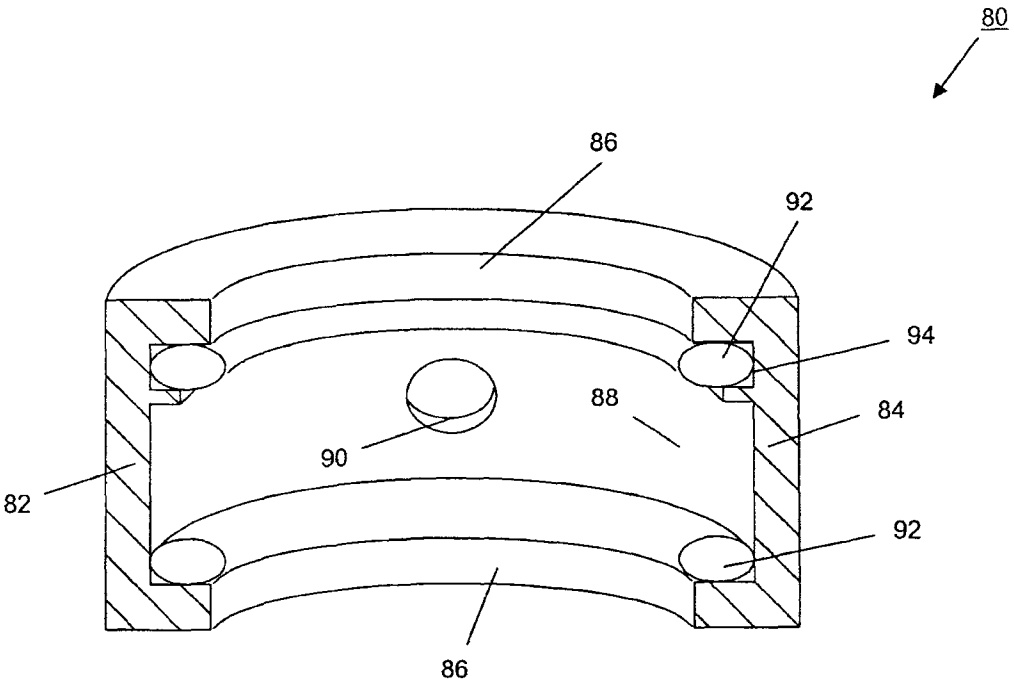
FIG. 3 is a cross sectional/perspective view illustrating one embodiment of a clamping assembly/sealing device that is used with the continuous circulation sub of FIGS. 1 and 2.

The CCS 10 of the present disclosure may operate in a number of modes, including a top circulation mode A, illustrated in FIG. 1 a, and a drill string connection/hook circulation mode B that include the use of a clamping/circulating assembly 21, discussed in further detail below (referenced in FIGS. 2 and 3). FIG. 1*a* illustrates the CCS 10 in the top circulation mode A and configured for top circulation, i.e., during drilling operations, whereas FIG. 2 illustrates CCS 10 in drill string connection/hook circulation mode B and configured to permit continuous circulation of drilling fluid through the drill string during a drill string connection/hook. In one embodiment, the CCS 10 is approximately 4-5 ft in length and is configured to allow its attachment to the top of a drill pipe/drill stand 11. In one embodiment, a plurality of CCS's may be used with the drill string such as, for example, by providing a CCS on each drill pipe/drill stand such that continuous circulation of the drilling fluid may be provided for each drill pipe attached to the drill string, as discussed below.

The CCS 10 includes an elongated housing 10*a* having a first end 10*b* and a second end 10*c* located opposite the housing 10*a* from the first end 10*b*. An internal flow path 10*d* is generally defined axially within the wall of the housing 10*a* of the CCS 10 between the first end 10*b* and the second end 10*c* to allow for axial flow of a drilling fluid therethrough. A drilling fluid inlet port 13 is defined by the housing 10*a* of the CCS 10 and extends through the wall of the housing 10*a* to the internal flow path 10*d*. In one embodiment, the drilling fluid inlet port 13 is located near the lower end of CCS 10 adjacent the second end 10*c* of the housing 10*a*. In one embodiment, a plurality of the inlet ports 13 (e.g., four) are radially positioned around a central axis of the CCS 10 and are in fluid communication with the internal flow path 10*d* to allow radial flow through the inlet ports 13 to the internal flow path 10*d*.

The CCS 10 preferable includes at least two valves. A first valve 18 is disposed to regulate axial drilling fluid flow through the internal flow path 10*d* of the housing 10*a* from the first end 10*b* to the second end 10*c* of the CCS 10, as discussed in further detail below. In one embodiment, first valve 18 is positioned within housing 10*a* of the CCS 10 adjacent the first end 10*b*. In one embodiment, the first valve 18 may be manually or automatically actuated. A second valve 16 is disposed adjacent the inlet port 13, and is operable to regulate drilling fluid flow through the inlet port 13 to the internal flow path 10*d*, as discussed in further detail below. In one embodiment, the second valve 16 may be manually or automatically actuated.

In one embodiment, the second valve 16 is a sliding gate sleeve disposed in the internal flow path 10*d* defined by the housing 10*a* of the CCS 10. The second valve 16 includes a sleeve or wall 16*a* and is operable to move between a first or closed position, when the CCS 10 is in the top circulation mode A as illustrated in FIG. 1*a*, in which a portion of the wall 16*a* of the second valve 16 is located adjacent the inlet port 13 such that the inlet port 13 is closed off from the internal flow path 10*d*, and a second or open position, when the CCS 10 is in the drill string connection/hook circulation mode B as illustrated in FIG. 2, in which the wall 16*a* of the second valve 16 is spaced apart from the inlet port 13 such that the inlet port 13 is in fluid communication with the internal flow path 10*d* and drilling fluid may pass through the inlet port 13 radially into the internal flow path 10*d* of the housing 10*a*. Second valve 16 preferably includes a pressure surface 15 formed thereon. While pressure surface 15 may be of any shape and integrally formed with sleeve 16*a* or a separate component of valve 16, in the illustrated embodiment pressure surface 15 is a shoulder that extends around the periphery of sleeve 16*a* into a pressure chamber 10*e* defined by the housing 35 of the CCS 10. In one embodiment, the pressure surface 15 may include a first side and a second side of a shoulder (e.g., opposite sides of the shoulder 15 in the pressure chamber 10*e*.)

In one embodiment, the first valve 18 may include a rotatable ball valve that defines a drilling fluid passageway 18*a*, such as is illustrated in FIGS. 1 and 2. In another embodiment, the first valve 18 may include a flapper valve. While a few examples of the first valve 18 have been provided, one of skill in the art will recognize that a variety of types of valves may be included in the CCS 10 to the extent they are suitable for the purposes described herein. The first valve 18 may be oriented in a first or open position, when the CCS 10 is in the top circulation mode A as illustrated in FIG. 1*a*, in which the drilling fluid passageway 18*a* is substantially aligned with the internal flow path 10*d* such that drilling fluid may travel axially through the first end 10*b* of the housing 10*a*, through the drilling fluid passageway 18*a* and the internal flow path 10*d* of the housing 10*a*, and through the second end 10*c* of the housing 10*a*. The first valve 18 may be moved to a second or closed position, when the CCS 10 is in the drill string connection/hook circulation mode B as illustrated in FIG. 2, in which the drilling fluid passageway 18*a* is oriented substantially perpendicularly to the internal flow path 10*d* such that the internal flow path 10*d* is closed off from the top drive/Kelly connection and drilling fluid may not pass into the housing 10*a* from the first end 10*b*.

In one embodiment, when drilling fluid is passing through one of the open valves 16 or 18, the other valve is fully closed and vice versa, while in another embodiment, a flow of drilling fluid through one of the valves 16 or 18 may be gradually increased or decreased as flow of drilling fluid through the other valve is correspondingly gradually decreased or increased, respectively. In this latter embodiment, such gradual opening and closing may continue until one of the valves 16 and 18 is fully closed and all flow of drilling fluid is through the other valve.

The CCS 10 also includes a biasing member 17 such as, for example, a spring, that is operable to provide a biasing force to urge the second valve 16 into the first or closed position when the CCS 10 is in the top circulation mode A, as illustrated in FIG. 1*a*. In the illustrated embodiment, the biasing member 17 is located in the pressure chamber 35 defined by the housing 10*a* and provides the biasing force against a shoulder on one side of pressure surface 15. In another embodiment, a shoulder or seat separate from pressure surface 15 may be provided against which biasing member 17 may bear.

In one embodiment of the invention, a pressure port 33 may be provided to facilitate actuation of second valve 16. In this embodiment pressure port 33 is defined by the housing 10*a* and extends through the wall of the housing 10*a* of the CCS 10 and into the pressure chamber 35. The pressure port 33 is operable to permit a pressurized fluid to enter the pressure chamber 35 in order to act upon one side of pressure surface 15, thereby counteracting the biasing force from the biasing member 17 and urging the second valve 16 into the second position, as illustrated in FIG. 2. In the illustrated embodiment, the pressure port 33 is in fluid communication with a first area of the pressure chamber 35 so as to provide an upward force on one side of the pressure surface of the shoulder 15. In one embodiment, the biasing member 17 need not be positioned in any particular location on the CCS 10 so long as it provides the function of urging the second valve 16 into the first or closed position when the CCS 10 is in the top circulation mode A, as illustrated in FIG. 1*a*. Pressure chamber 35 may be provided with a vent 37. Vent 37 is defined in the housing 10*a* and extends through the wall of the housing 10*a* to an second area of the pressure chamber 35 in which pressure port 33 is not in fluid communication.

In another embodiment, the biasing member 17 may be positioned in the pressure chamber 35 opposite the second valve 16 from the position illustrated in FIGS. 1 and 2 (e.g., below the shoulder 15 rather than above the shoulder 15 as illustrated in FIGS. 1 and 2). In such an embodiment, the biasing member 17 would then urge the second valve 16 into the second or open position when the CCS 10 is in the drill string connection/hook circulation mode B. In that embodiment, the pressure port 33 and valve 37 would have their locations reversed such that the pressure port is in fluid communication with the second area of the pressure chamber 35 so as to provide a downward pressure on one side of the pressure surface of the shoulder 15 when pressurized fluid is provided through the pressure port 33 to move the second valve 16 to the first or closed position.

When making a drill string connection/hook at the drill/rig floor 19, pressurized fluid may be provided through the pressure port 33. Pressurized fluid provided through the pressure port 33 results in a force on the side of the pressure surface of the shoulder 15 that is located adjacent the pressure port 33. That force moves the second valve 16 from the first or closed position where the CCS 10 is in the top circulation mode A, as illustrated in FIG. 1*a*, to the second or open position where the CCS 10 is in the drill string connection/hook circulation mode B, as illustrated in FIG. 2. In one embodiment, pressurized fluid provided through pressure port 33 is released before releasing pressurized fluid provided through the inlet ports 13. Pressurized fluid may be provided to pressure port 33 with a surrounding seal mechanism, or a stab and snap connection, or using a variety of other mechanisms known in the art for pressurized fluid.

In one embodiment, a CCS 10 is pre-installed on the top of each drill pipe/drill stand 11 prior to attachment of the drill pipe/drill stand 11 to the existing drill string. In one embodiment, the drill string consists of a CCS 10 disposed between any two consecutive drill pipe sections 11 in the overall drill string. Thus, individual drill pipe sections 11 and CCSs 10 may alternate along the length of the drill string.

In one embodiment, shown in FIG. 1*b*, an additional pressure port 25 may be defined by the housing 10*a* of the CCS 10 and be operable to provide a pressurized fluid to activate movement of the first valve 18. In this regard, first valve 18 may be provided with a pressure surface 19*a* in fluid communication with the pressure port 25 such that pressurized fluid provided via the pressure port 25 urges rotation of the first valve 18 to a open position. Likewise, a biasing element 19*b* may be provided so as to provide a counter rotation force on the first valve 18 urging the first valve 18 into a closed position. In the illustrated embodiment, the pressure surface 19*a* is provided on a first shoulder extending into a pressure chamber 19*c*, and the first valve 18 includes a second shoulder 19*d* against which the biasing element 19*b* acts. In another embodiment, the pressure surface may be a groove formed in the first valve 18.

Figure 6:
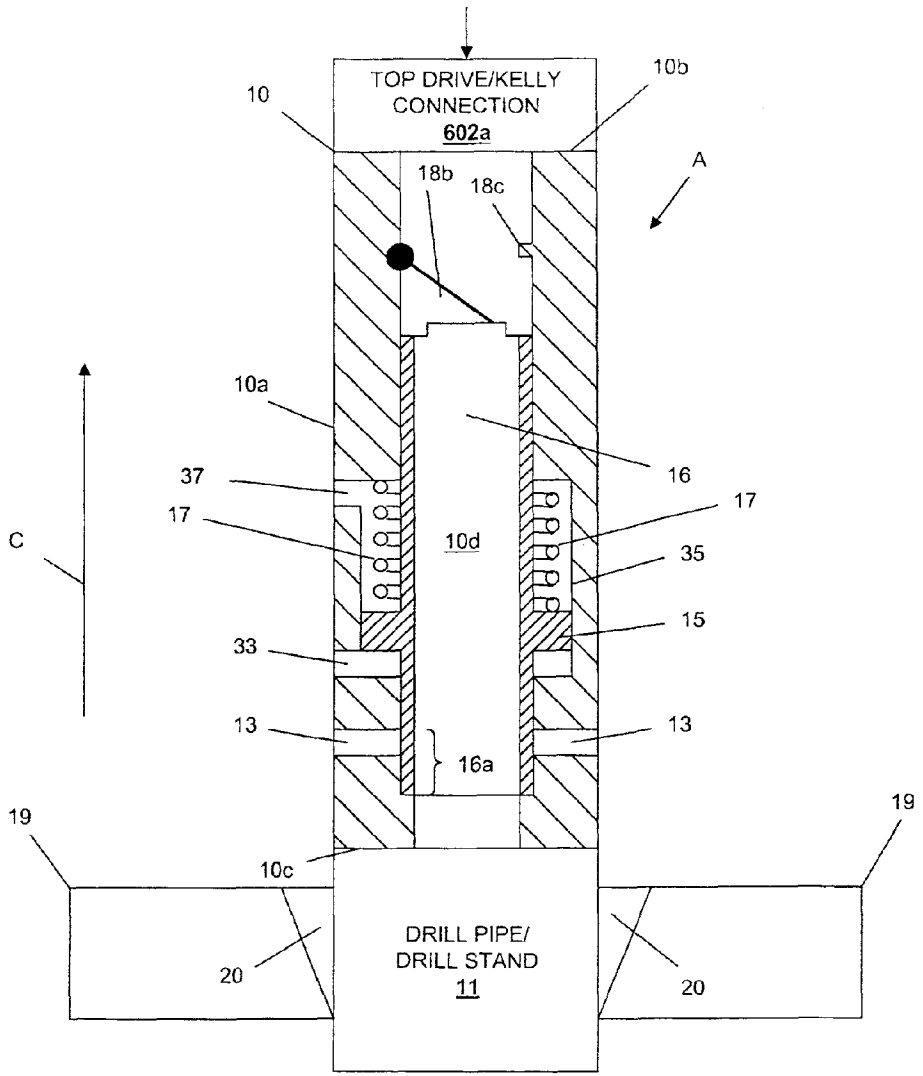
FIG. 6 is a cross-sectional view illustrating one embodiment of the continuous circulation sub in which a valve sleeve urges a flapper valve to a closed position.

Valves 16 or 18 may be independent of one another or operatively coupled. In one embodiment, as valve 16 is urged from a first closed position to a second open position, the sleeve 16*a* engages the valve 18 to urge the valve 18 from an open position to a closed position. For example, in one embodiment, the first valve 18 may be coupled to the second valve 16 and be operable to be mechanically rotated in response to the sliding movement of the second valve 16 relative to the housing 10*a*. Likewise, in another embodiment, sleeve 16*a* is operable to be actuated (e.g., with a pressurized fluid through the pressure port 33) to urge a flapper valve 18*b* against a valve seat 18*c*, such as is shown in FIG. 6, to move the system from the top circulation mode A to the drill string connection/hook circulation mode B. Finally, in another embodiment, a pressurized fluid may be used to simultaneously activate movement of both valves 16 and 18, closing one valve while opening the other valve.

In one embodiment, when a drill string connection/hook is to be made on the drill/rig floor 19, the drill pipe/drill stand that is coupled to the drill string is set in slips 20 such that the CCS 10 that is coupled to that drill pipe 11 is located adjacent the drill/rig floor 19. In one embodiment, the rotation of a drilling tubular is stopped to set the slips 20. A clamping assembly/sealing device 21 is then engaged with the CCS 10 adjacent the inlet ports 13. In one embodiment, the clamping assembly/sealing device 21 extends fully around the perimeter of the CCS 10, although other coupling orientations and clamping assembly/sealing device structures are envisioned as falling within the scope of the present disclosure. In one embodiment, the clamping assembly/sealing device 21 may include tongs having an automated iron roughneck 22 which grips the CCS 10 such that seals 24 on the clamping assembly/sealing device 21 engage the housing 10*a* above and below the inlet ports 13 in order to seal the clamping assembly/sealing device 21 to the CCS 10.

The clamping assembly/sealing device 21 may include one or more collars that engage the CCS 10. One embodiment of a collar is illustrated in FIG. 3, and shows one of a pair of semicircular collars 80 that are included in the clamping assembly/sealing device 21 collar. Each semicircular collar 80 includes a first end 82 and a second end 84 and an interior surface 86 extending therebetween. When two of the semicircular collars 80 are radially positioned around the CCS 10, the respective ends 82 and 84 abut to form a full, peripheral sealing mechanism around the CCS 10. In this embodiment, each collar 80 may include a recess or channel 88, defined by the interior surface 86, that forms a drilling fluid flow path between the semicircular collar 80 and the CCS 10 when the pair of semicircular collars 80 are seated on the exterior surface of CCS 10. In one embodiment, the recess or channel 88 is C-shaped. At least one of the collars 80 defines a drilling fluid flow port 90 that extends through the collar 80 and into fluid communication with the recess or channel 88. In one embodiment, the clamping assembly/sealing device 21 avoids the need to specifically connect or "stab in" a hose 26 (see FIG. 2) to the inlet port 13. In addition, the clamping assembly/sealing device 21 permits the use of multiple inlet ports 13 around the perimeter of the CCS 10. The ends 82 and 84 may further include a locking mechanism to secure the respective ends to one another and sealingly couple the clamping assembly/sealing device 21 around the CCS 10. Alternatively, as discussed above, an external radial force may be applied to each collar 80 to sealingly coupled the clamping assembly/sealing device 21 around the CCS 10

A pair of sealing members 92 may be disposed adjacent the interior surface 86 on opposite sides of the drilling fluid flow port 90. In one embodiment, the sealing members 92 may be the sealing members 24, illustrated in FIG. 2. In one embodiment, a groove 94 may be defined by the interior surface 86 for receipt of one or both of the sealing members 92. In one embodiment, the sealing members 92 may include o-rings or some other elastomeric material, metals, non-metal materials, and/or a variety of other sealing members known in the art.

With reference to FIG. 2, a hose 26 is coupled to the clamping assembly/sealing device 21 and may be in fluid communication with the drilling fluid flow port 90 defined by the collar 80 in order to provide a drilling fluid from a drilling fluid reservoir to the CCS 10. In an alternative embodiment, a second clamping assembly/sealing device 96 may be sealingly coupled to the CCS 10, similarly to the clamping assembly/sealing device 21, and coupled to a hose 97 such that the hose 97 is in fluid communication with the pressure port 33 through a fluid flow port defined by the second clamping assembly/sealing device 96. In another embodiment, the clamping assembly/sealing device 21 and/or the hose 26 may be coupled to the second clamping assembly/sealing device 96 such that pressurized fluid may be provided through the pressure port 33 without the need for the hose 97. In an alternative embodiment, collars 80 may be of sufficient width to simultaneously provide fluid communication between the hose 26 and the inlet ports 13 and pressure port 33. In an alternative embodiment, the pressure port 33 may be split off from the inlet port 13 and formed in the CCS 10, in which case, the pressure port 33 need not extend through the housing 10*a* of the CCS 10.

In one embodiment, the foregoing clamping assembly/sealing device 21 may be readily operated automatically on the rig floor 19, thereby minimizing the need for personnel to be near the drill string connection/hook operation and in particular, near the CCS 10 during such operations. In the very least, the clamping assembly/sealing device 21 engages the CCS 10 in a manner that minimizes the need for personnel in the vicinity of the rig floor 19 and slips 20.

Figure 4:
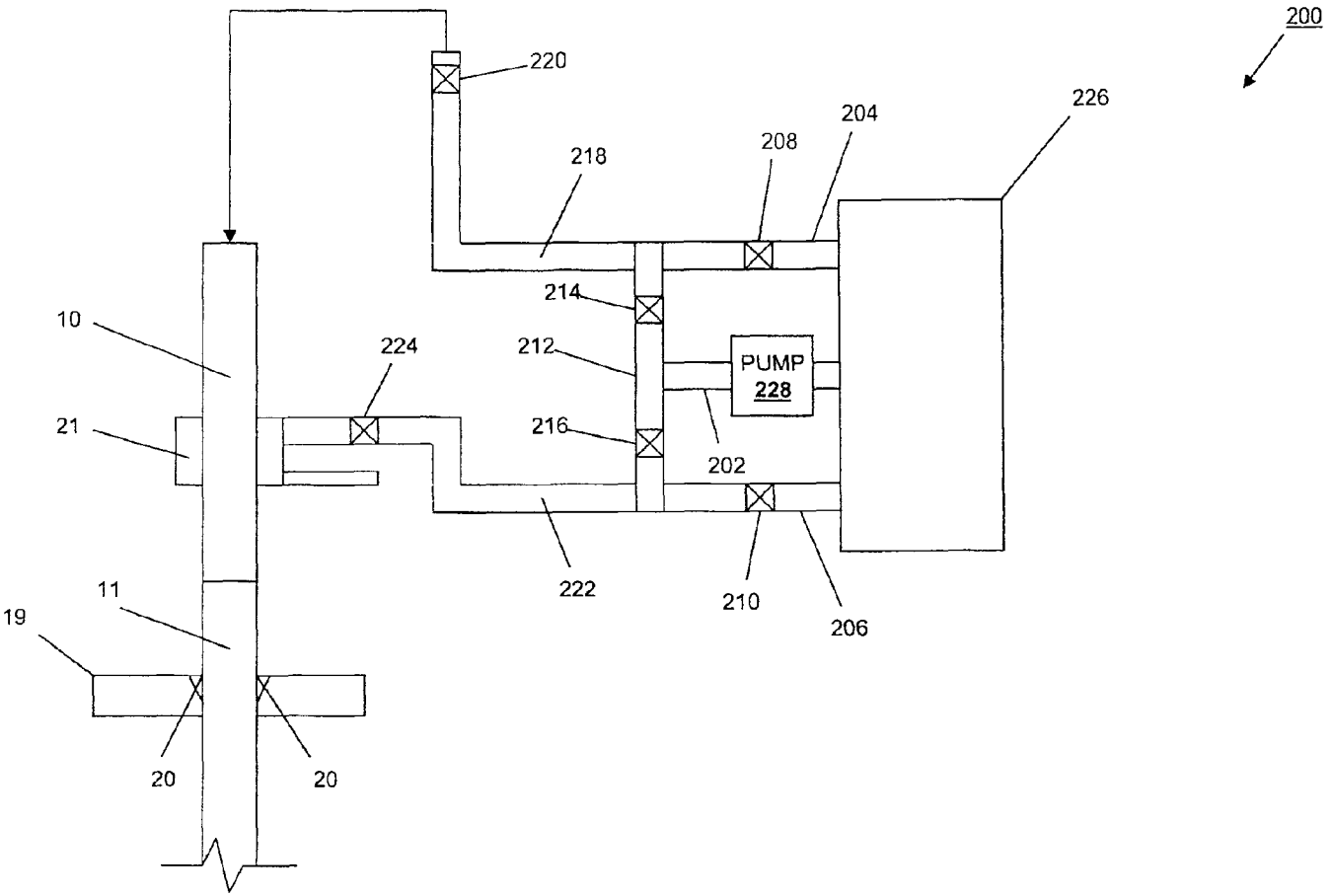
FIG. 4 is a schematic view illustrating one embodiment of a piping manifold that is used with the continuous circulation sub of FIGS. 1 and 2.

Referring now to FIG. 4, one embodiment of a piping manifold 200 is shown. The manifold 200 is operable to supply drilling fluid to the CCS 10 and clamping assembly/sealing device 21. Manifold 200 includes drilling fluid reservoir 226 coupled to a primary supply drilling fluid line 202 and a pair of return drilling fluid lines 204 and 206. The return drilling fluid lines 204 and 206 include valves 208 and 210, respectively. The valves 208 and 210 may be drain valves, dump valve, pressure relief valves, and/or a variety of other valves know in the art. The primary supply drilling fluid line 202 and the return drilling fluid lines 204 and 206 are each connected to a distribution pipe manifold 212 having a fluid inlet and two fluid outlets, as illustrated in FIG. 4. The distribution pipe manifold 212 includes valves 214 and 216. A top drive/Kelly supply line 218 is connected to the distribution pipe manifold 212. The top drive/Kelly supply line 218 may optionally include a valve 220. A CCS supply line 222 is connected to the distribution pipe manifold 212 and to the clamping assembly/sealing device 21. The CCS supply line 222 may include a valve 224 located near the connection of the CCS supply line 222 to the clamping assembly 21.

In normal operation during drilling, a pump 228 is used to pump drilling fluid from the drilling fluid reservoir 226 (e.g., mud tanks), through the supply drilling fluid line 202, through the distribution pipe manifold 212, and through top drive/Kelly line 218 to flow through either the top drive or the Kelly and then into the drilling pipe 11 via the first end 10*b* of CCS 10. During this time, valves 214 and 220 are open and valves 208, 210 and 216 are closed. When it is time for new joint of drill pipe or a new drill stand to be added to the drill string, the slips 20 are set and the clamping assembly/sealing device 21 is engaged with CCS 10. Then valves 216 and 224 are opened and the second valve 16 in the circulating sub 10 is activated by applying pressure through the pressure port 33 as described above. Drilling fluid will then flow through both the top drive/Kelly supply line 218 and the CCS supply line 222. The first valve 18 at the top of the CCS 10 may then either be manually or automatically closed in response to, for example, the operation of the second valve 16, or by application of a pressurized fluid through the pressure port 25. In one embodiment, the valves 220 and 214 are then closed and the valve 208 is opened to relieve pressure and/or allow drilling fluid to drain back to drilling fluid reservoir 226. After the closing of the valve 220, the top drive or Kelly may be disconnected from the CCS 10 and a new joint of drill pipe or a new drill stand of several drill pipes may be connected to the top of the CCS 10. In one embodiment, another CCS 10 has been previously added to the top of the new joint of drill pipe or the new drill stand that is being connected to the top of the CCS 10 that is currently held in the slips 20.

After connecting a new joint of drill pipe/new drill stand, the drain valve 208 is closed, the valves 214 and 220 are opened, and the pump 228 is activated to pump drilling fluid through the top drive or Kelly. The second valve 16 may then be closed by bleeding pressure through the pressure port 33, and the first valve 18 in the CCS 10 may be opened, either manually or automatically, such as in the manner described above. The valve 216 is closed and drain valve 210 is opened to relieve the pressure in the CCS line 222 by allowing the drilling fluid to drain back to the drilling fluid reservoir 226. Finally, the valve 224 is closed and the clamping assembly/sealing device 21 is disconnected and drilling may resume.

Figure 5:
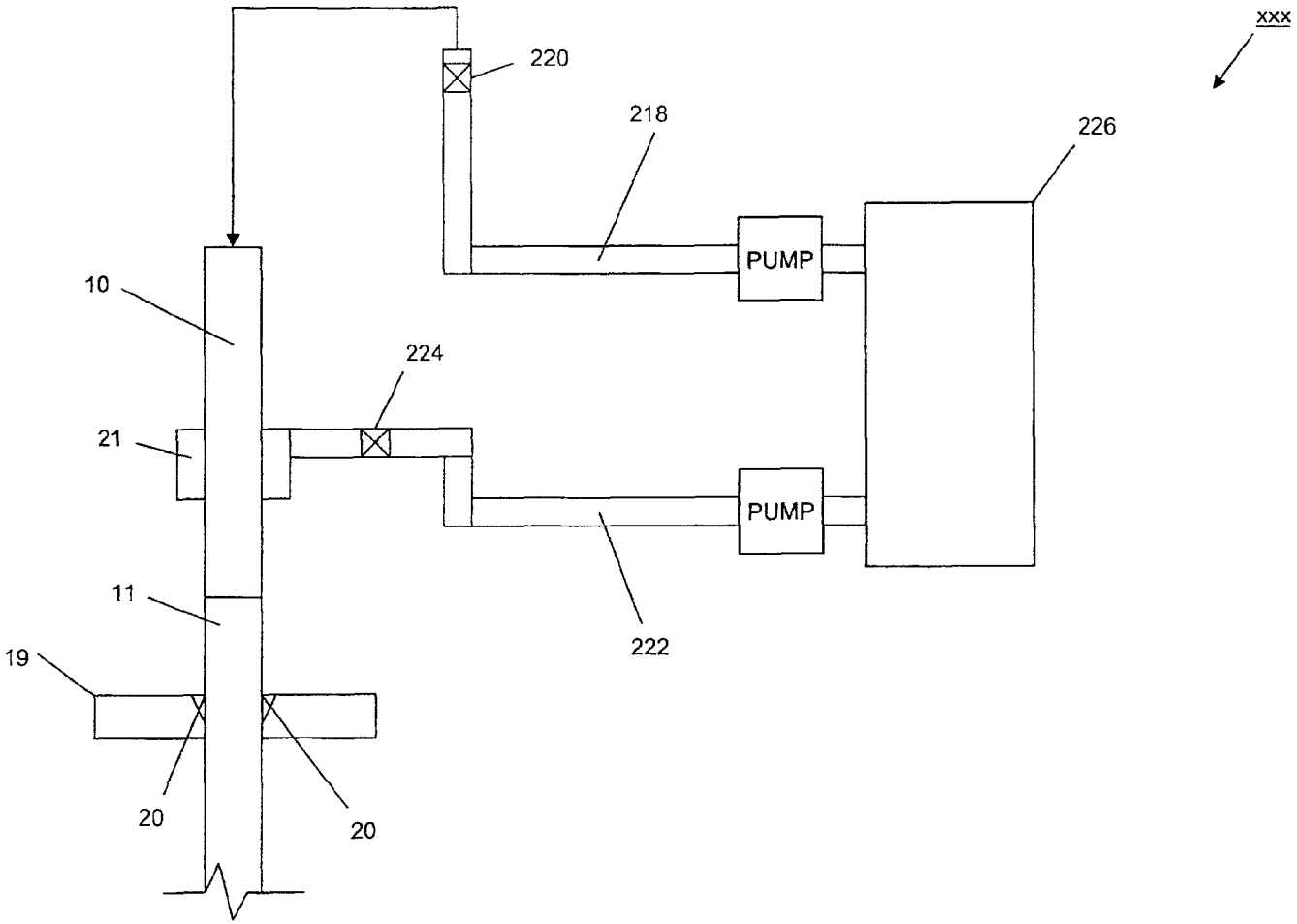
FIG. 5 is a schematic view illustrating one embodiment of a piping manifold that is used with the continuous circulation sub of FIGS. 1 and 2.

While an example of a piping manifold 200 has been illustrated, those skilled in the art will appreciate that other piping and valve arrangements are possible in order to supply drilling fluid to the system as described above. For example, a separate system of supply lines and valves may be independently attached to the CCS 10 and clamping assembly/sealing device 21, such as is illustrated in FIG. 5.

Figure 7:
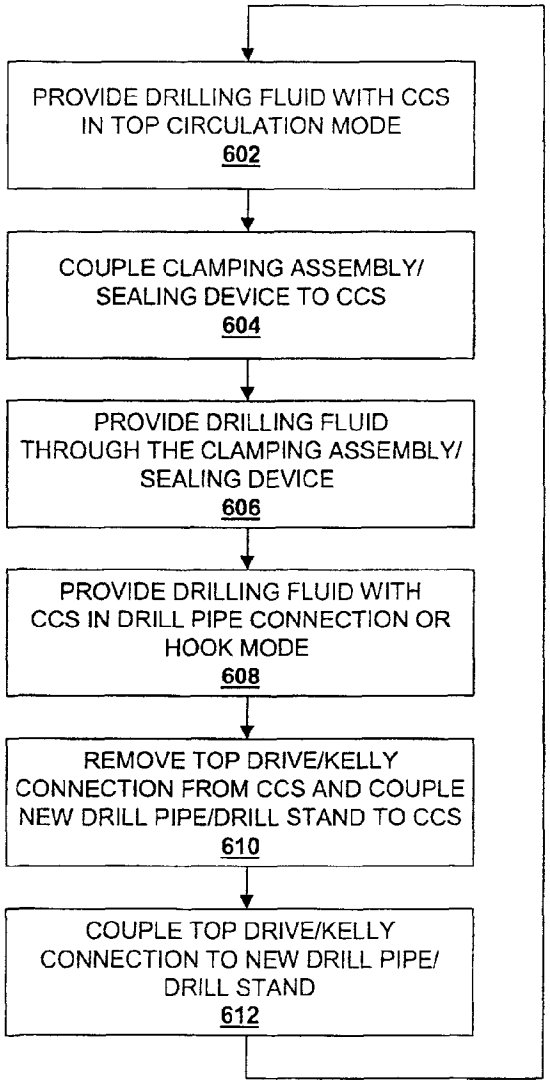
FIG. 7 is a flow-chart illustrating operation of the continuous circulation sub of the invention.

Referring now to FIG. 7, a method 600 for circulating drilling fluid is illustrated. The method 600 begins at block 602 where drilling fluid is provided with the CCS in a top circulation mode. In one embodiment the CCS 10 is provided coupled on its first end 10*b* to a top drive or Kelly connection 602*a* and on its second end 10*c* to the drill pipe/drill stand 11 that is held in the slips 20 on the rig floor 19, as illustrated in FIG. 1*a*. In one embodiment, the rotation of a drilling tubular may be stopped in order to set the slips 20 to hold the drill pipe/drill stand 10. As illustrated in FIG. 1*a* and described above, the CCS 10 is in a top circulation mode A, with the first valve 18 oriented in a first or open position such that the drilling fluid passageway 18*a* is substantially aligned with the internal flow path 10*d* and the second valve 16 oriented in a first or closed position in which the wall section 16*a* of the second valve 16 is located adjacent the inlet ports 13 such that the inlet ports 10 are closed off from the internal flow path 10*d*. With the CCS 10 in the top circulation mode, drilling fluid provided through the top drive or Kelly connection 602*a* (e.g., using the piping manifold 200 discussed above with reference to FIG. 4), passes through the first end 10*b* of the housing 10*a*, through the drilling fluid passageway 18*a* on the first valve 18, through the internal flow path 10*d*, through the second end 10*c* of the housing 10*a*, and through the drill pipe/drill stand 11 to the drill string. Thus, drilling fluid is circulated through the drill string at block 602 of the method. During block 602 of the method 600, a drilling tubular may be rotated.

The method 600 then proceeds to block 604 where a clamping assembly/sealing device is coupled to the CCS. In one embodiment, the clamping assembly/sealing device 21 and optionally the clamping assembly/sealing device 97 are coupled to the CCS 10, as described above, such that a seal is provided between the hose 26 and the inlet ports 13 and optionally the hose 97 (or 26) and the pressure port 33.) The hoses 26 and optionally 97 are coupled to the piping manifold 200, discussed above. During the coupling of the clamping assembly/sealing device 21 to the CCS 10, circulation of drilling fluid in the drill string through the top drive/Kelly connection continues.

The method 600 then proceeds to block 606 and 608 where drilling fluid is provided through the clamping assembly/sealing device and drilling fluid is provided to the CCS in drill pipe connection/hook circulation mode. As discussed above with reference to FIG. 4, the valves of the piping manifold 200 are opened and closed such that drilling fluid is provided from the drilling fluid reservoir 226, through the hose 26 and optionally hose 97, and to the clamping assembly/sealing device 21. In one embodiment, drilling fluid provided to the pressure port 33 results in a force on the pressure surface of the shoulder 15 that is coupled to the second valve 16, and that force is sufficient to overcome the biasing force of the biasing member 17 such that the second valve 16 is moved in a direction C, illustrated in FIG. 1*a*. Movement of the second valve 16 in the direction C moves the wall section 16*a* of the second valve 16 such that the wall section 16*a* is spaced apart from the inlet ports 13 and the inlet ports 10 are in fluid communication with the internal flow path 10*d* of the CCS 10. With the inlet ports 10 in fluid communication with the internal flow path 10*d* of the CCS 10, drilling fluid provided to the clamping assembly/sealing device 21 may pass through the inlet ports 13 to the internal flow path 10*d*, and then through the drill pipe/drill stand 11 and into the drill string. Thus, at block 608, drilling fluid provided through the clamping assembly/sealing device 21 is circulated through the drill string. In one embodiment, the movement of the second valve 16 results in the movement of the first valve 18 from the position illustrated in FIG. 1*a* to the position illustrated in FIG. 2, such that the drilling fluid passageway 18*a* is oriented substantially perpendicular to the internal flow path 10*d* and the internal flow path 10*d* is closed off so that drilling fluid may not pass from the top drive/Kelly connection 602*a* to the housing 10*a* through the first end 10*b*.

With the first valve 18 and the second valve 16 positioned as illustrated in FIG. 2, the CCS 10 is in a drill pipe connection/hook circulation mode B. With the CCS 10 in the drill pipe connection/hook circulation mode B, drilling fluid provided through the clamping assembly/sealing device 21 (e.g., using the piping manifold 200 discussed above with reference to FIG. 4), passes through the inlet ports 13 of the housing 10*a*, through the internal flow path 10*d*, through the second end 10*c* of the housing 10*a*, and through the drill pipe/drill stand 11 to the drill string, while the provision of the drilling fluid through the top drive/Kelly connection is stopped. Thus, drilling fluid is circulated through the drill string at block 608 of the method.

The method 600 then proceeds to block 610 where the top drive/Kelly connection is decoupled from the CCS. With the first valve and the second valve 16 positioned as illustrated in FIG. 2 such that all drilling fluid is provided through the clamping assembly/sealing device 21, the top drive/Kelly connection above the CCS 10 may be bled of pressurized fluid, e.g., using a piping manifold 200 such as is described above. The top drive/Kelly connection may then be decoupled from the CCS 10 and the next drill pipe section or drill stand 610*a* may be coupled to the CCS 10. As discussed above, a CCS 10 may be pre-installed on each new section of drill pipe or drill stand being coupled to the CCS 10 that is circulating drilling fluid through the drill string with its attached clamping assembly/sealing device 21. In another embodiment, the CCS 10 may be coupled to the new section of drill pipe or drill stand after it is coupled to the CCS 10 that is circulating drilling fluid through the drill string with its attached clamping assembly/sealing device 21.

The method 600 then proceeds to blocks 612 where the top drive/Kelly connection is coupled to the new section of drill pipe or drill stand and returns to block 602 where drilling fluid is provided with the CCS in a top circulation mode. A top drive/Kelly connection (similar to the top drive/Kelly connection 602*a* of FIG. 1*a*) may be coupled to the CCS 10 on the new drill pipe or drill stand 610*a*. As discussed above with reference to FIG. 4, the valves of the piping manifold 200 are then opened and closed such that drilling fluid is provided from the drilling fluid reservoir 226 to the top drive/Kelly connection 602*a*. The first valve 18 may then be actuated such that the drilling fluid passageway 18*a* becomes substantially aligned with the internal flow path 10*d* and drilling fluid from the top drive/Kelly connection may pass through the first end 10*b* of the housing 10*a*, through the drilling fluid passageway 18*a* and the internal flow path 10*d*, and through the second end 10*c* of the housing 10*a*. In one embodiment, the provision of drilling fluid from the top drive/Kelly connection is gradually increased, which gradually reduces the flow of drilling fluid from the clamping assembly/sealing device 21 to the CCS 10. In one embodiment, with drilling fluid being provided through the top drive/Kelly connection, rotation of the drilling tubular may be resumed.

As discussed above with reference to FIG. 4, the valves of the piping manifold 200 may then be opened and closed such that drilling fluid is no longer provided from the drilling fluid reservoir 226 to clamping assembly/sealing device 21. In one embodiment, no longer providing the drilling fluid to the clamping assembly/sealing device 21 removes the pressurized fluid from the pressure chamber 35 such that a force is no longer provided on the pressure surface of the shoulder 15. Removal of that force causes the second valve 16 to move such that the wall section 16*a* of the second valve 16 is located adjacent the inlet ports 13 and the inlet ports 13 are closed off from the internal flow path 10*d*. The clamping assembly/sealing device 21 may removed from the CCS 10 such that the new drill pipe/drill stand 610*a* can be moved down to the rig floor 19 and held in the slips 20 and another drill pipe/drill stand can be attached to the drill string.

Those skilled in the art will appreciate that the system described above can continuously circulate drilling fluid during drill pipe connection/hook operations to maintain the ECD in the annulus, thus allowing drilling with a lower drilling fluid weight. Furthermore, the system described above is primarily disposed for use adjacent to or at the rig floor. The system is an improvement over the prior art systems which utilize a BOP system on the rig floor to temporarily close off downhole fluid flow when new drill pipe sections are added to the top of the drill string. Those skilled in the art will appreciate that while various components may be described as translating up or down, the particular direction of movement is not intended as a limitation.

A continuous circulation sub has been described that includes an elongated sub housing having a first end and a second end and characterized by a wall defining a sub interior and at least one inlet flow port disposed in said wall, wherein the sub housing has an internal flow path formed in the interior therein between the first and second ends, a sleeve disposed at least partially in the interior of the sub housing, the sleeve having a sleeve wall, wherein the sleeve is axially movable within the sub housing from a closed position to an open position, such that the sleeve wall substantially impedes fluid flow from the housing inlet flow port to internal flow path when the sleeve is in the closed position and wherein the inlet flow port and the internal flow path are in fluid communication when the sleeve is in the open position, wherein the sleeve has a pressure surface defined thereon so as to provide a surface area upon which a first fluid pressure may act to urge the sleeve from the closed position to the open position, a biasing member, wherein the biasing member urges the valve sleeve to the closed position by exertion of a biasing force on the sleeve, and a valve disposed along the internal flow path, wherein the valve is movable between a first position so as to permit flow through the flow path between said first and second ends of the sub housing and a second position inhibiting flow through the flow path between said first and second ends of the sub housing, wherein the valve is in the first position when the sleeve is in the closed position and the valve is in the second position when the sleeve is in the open position. In one embodiment, said valve is a ball valve.

In one embodiment, said valve is a flapper valve. In one embodiment, said valve includes a plurality of inlet flow ports radially disposed in said wall. In one embodiment, a pressure port extends through said wall and in fluid communication with said pressure surface. In one embodiment, a pressure chamber is defined in the sub, wherein the pressure surface of said sleeve is disposed in said pressure chamber and said pressure port is in fluid communication with said chamber. In one embodiment, said pressure surface includes a first side and a second side, wherein said pressure port is in fluid communication with the first side of said pressure surface and, said sub further including a vent port in fluid communication with the second side of said pressure surface. In one embodiment, said biasing member is disposed in said in said chamber adjacent the vent port and against said second side of said pressure surface. In one embodiment, said biasing member is a spring.

A continuous circulation system for a drill string has been described that includes a continuous circulation sub including an elongated sub housing having a first end and a second end and an exterior surface and characterized by a wall defining a sub interior and at least one inlet flow port disposed in said wall, wherein the sub housing has an internal flow path formed in the interior therein between the first and second ends, a sleeve disposed at least partially in the interior of the sub housing, the sleeve having a sleeve wall, wherein the sleeve is axially movable within the sub housing from a closed position to an open position, such that the sleeve wall substantially impedes fluid flow from the housing inlet flow port to internal flow path when the sleeve is in the closed position and wherein the inlet flow port and the internal flow path are in fluid communication when the sleeve is in the open position, wherein the sleeve has a pressure surface defined thereon so as to provide a surface area upon which a first fluid pressure may act to urge the sleeve from the closed position to the open position, a spring, wherein the spring biases the valve sleeve to the closed position by exertion of a biasing force on the sleeve, and a valve disposed along the internal flow path, wherein the valve is movable between a first position so as to permit flow through the flow path between said first and second ends of the sub housing and a second position inhibiting flow through the flow path between said first and second ends of the sub housing, wherein the valve is in the first position when the sleeve is in the closed position and the valve is in the second position when the sleeve is in the open position, and an external sealing device, said external sealing device including a clamp body disposed to engage the exterior surface of the sub housing, and a flow port passing through said clamp body. In one embodiment, said clamp body includes a collar disposed to radially engage the sub housing, said collar having an interior surface and an exterior surface and a first end and a second end. In one embodiment, the system includes two collars, wherein each collar is semi-circular in shape. In one embodiment, the system includes a plurality of collars, wherein said collars form an annular member around said sub housing when the respective ends of said collars abut. In one embodiment, a channel is formed along the interior surface between the two ends. In one embodiment, said channel is c-shaped. In one embodiment, said flow port passes through said collar from said interior surface to said exterior surface. In one embodiment, a sealing member is disposed along the interior surface between the two ends. In one embodiment, a first channel is formed along the interior surface between the two ends, and a flow port axially passes through said collar from said interior surface to said exterior surface so as to be in fluid communication with said channel. In one embodiment, a first sealing member is disposed in said channel along the interior surface between the two ends above the flow port and a second sealing member is disposed in said channel along the interior surface between the two ends below the flow port. In one embodiment, said interior surface includes a second channel formed along the interior surface between the two ends, said clamp body further including a second flow port extending therethrough and in fluid communication with said second channel. In one embodiment, a hose is in fluid communication with said flow port. In one embodiment, said hose is in fluid communication with a drilling fluid reservoir. In one embodiment, the system includes a drilling fluid reservoir, a first drilling fluid supply line in fluid communication with the first end of the sub and a second drilling fluid supply line in fluid communication with the flow port of said external sealing device. In one embodiment, said clamp body includes a first semi-circular section and a second semi-circular section. In one embodiment, the system includes a drill string, said drill string including a plurality of elongated drill pipe sections and a plurality of continuous circulation subs, wherein a sub alternatingly disposed between drill pipe sections along the length of the drill string.

A continuous circulation system for a drill string has been described that includes at least one section of drilling pipe having an upper end and a lower end and an annulus therethrough, a first drilling fluid supply line attached to the upper end of said drilling pipe section and in fluid communication with said annulus, a continuous circulation sub attached to the lower end of said drilling pipe section, said continuous circulation sub including an elongated housing having a first end and a second end and an exterior surface and characterized by a wall defining a sub interior, said sub having at least one inlet flow port disposed in said wall and in fluid communication with an internal flow path formed in the interior of said housing between the first and second ends, a clamping assembly having a flow port defined therein, said clamping assembly radially disposed around at least a portion of the perimeter of the exterior surface of the sub so that said clamping assembly flow port is in fluid communication with said sub inlet flow port, and a second drilling fluid supply line in fluid communication with said clamping assembly flow port. In one embodiment, the system includes a drilling fluid reservoir in fluid communication with said first and second drilling fluid supply lines. In one embodiment, each supply line includes a valve disposed therein, wherein each valve is movable between a first position where it is open and a second position where it is fully closed, wherein one of said valves is in the first position when the other valve is in the second position. In one embodiment, said clamping assembly are tongs. In one embodiment, said continuous circulating sub further includes a pressure port, said system further including a pressure source in fluid communication with said pressure port. In one embodiment, said pressure source is a drilling fluid reservoir. In one embodiment, said continuous circulating sub further includes a pressure port, wherein said clamping assembly flow port is in fluid communication with said pressure port. In one embodiment, the system includes a first return line in fluid communication with said reservoir and a second return line in fluid communication with said reservoir. In one embodiment, the system includes a primary supply line in fluid communication with said first and second supply lines and said reservoir, a first return line in fluid communication with said reservoir and said first supply line and a second return line in fluid communication with said reservoir and said second supply line. In one embodiment, the system includes a valve disposed in each of the first and second supply lines and each of the first and second return lines, wherein each valve is movable between a first position where it is open and a second position where it is fully closed, said primary supply line further including a manifold having a drilling fluid inlet, first outlet in fluid communication with said first supply line and a second outlet in fluid communication with said second supply line, said system further including a first manifold valve between said drilling fluid inlet and said first outlet and a second manifold valve between said drilling fluid inlet and said second outlet. In one embodiment, said sub further includes a first valve disposed in the internal flow path and a second valve disposed between the inlet flow port and the internal flow path. In one embodiment, the first valve includes a ball valve and the second valve includes an axially movable sleeve slidably mounted in said sub interior.

A continuous circulation system for a drill string has been described that includes at least one section of drilling pipe having an upper end and a lower end and an annulus therethrough, a continuous circulation sub attached to the lower end of said drilling pipe section, said continuous circulation sub including an elongated housing having a first end and a second end and an exterior surface and characterized by a wall defining a sub interior, said sub having at least one inlet flow port disposed in said wall and in fluid communication with an internal flow path formed in the interior of said housing between the first and second ends, a clamping assembly having a flow port defined therein, said clamping assembly radially disposed around at least a portion of the perimeter of the exterior surface of the sub so that said clamping assembly flow port is in fluid communication with said sub inlet flow port, a drilling fluid reservoir, and a drilling fluid manifold, said manifold having a drilling fluid inlet in fluid communication with said reservoir, a first outlet in fluid communication with said sub annulus and a second outlet in fluid communication with said clamping assembly flow port.

A method of drilling a borehole that allows for continuous circulation of drilling fluid while making a drill string connection has been described that includes connecting a first continuous circulation sub to the top of a drilling tubular, circulating drilling fluid through the top of the first continuous circulation sub while rotating the drilling tubular, stopping rotation of the drilling tubular and setting slips to hold the drill string, connecting a circulation device to the first continuous circulation sub without stopping circulation of drilling fluid through the top of the first continuous circulation sub, circulating drilling fluid through the first continuous circulation sub via the circulation device, stopping circulation through the top of the first continuous circulation sub while continuing to circulate through the first continuous circulation sub via the circulation device, connecting an additional drilling tubular to the top of the first continuous circulation sub with a second continuous circulation sub connected to the top of the additional drilling tubular, circulating drilling fluid through the top of the second continuous circulation sub and stop circulating fluid through the first continuous circulation sub, and resume rotating the drilling tubular. In one embodiment, the circulating drilling fluid through the first continuous circulation sub via the circulation device further includes closing a first valve in the first continuous circulation sub and opening a second valve in the first continuous circulation sub. In one embodiment, the circulating drilling fluid through the first continuous circulation sub via the circulation device further includes closing a first valve in a drilling fluid manifold and opening a second valve in the drilling fluid manifold to reduce drilling fluid pressure in a drilling fluid line to the top of the first continuous circulation sub. In one embodiment, the circulating drilling fluid through the top of the second continuous circulation sub and stop circulating fluid through the first continuous circulation sub via the circulation device further includes closing the first valve in the first continuous circulation sub and opening the second valve in the first continuous circulation sub.

A system for drilling a borehole that allows for continuous circulation of drilling fluid while making a drill string connection has been described that includes a plurality of continuous circulation subs, each unit including a pin and box connection for threaded connections with drilling tubulars, a first valve, an inlet port for receiving a supply of drilling fluid; and a second valve for closing the inlet port, a circulation device that fluidicly connected to the inlet port of the continuous circulation sub; and a piping manifold including a drilling fluid line to the circulation device and a drilling fluid line to the top of the continuous circulation sub.

A method for maintaining continuous flow through a drillstring during drill pipe connection has been described that includes establishing drilling fluid flow axially through the length of a tubular sub attached to the top of a drill string, engaging said sub with a collar disposed at least partially around the perimeter of said sub so as to define an exterior flow path along the exterior of said sub, initiating radial flow into said sub through said collar and along said exterior flow path, terminating axial flow through the length of the tubular sub while maintaining radial flow into said sub, attaching a pipe joint to the top of the tubular sub, reestablishing axial flow through the length of the tubular sub, terminating radial flow into said sub, and disengaging said collar from said sub. In one embodiment, the radial flow into said sub is via a plurality of flow ports provided around the perimeter of said sub.

While certain features and embodiments of the present disclosure have been described in detail herein, it will be readily understood that the present disclosure encompasses all modifications and enhancements within the scope and spirit of the following claims. Furthermore, no limitations are intended in the details of construction or design herein shown, other than as described in the claims below. Moreover, those skilled in the art will appreciate that description of various components as being oriented vertically or horizontally are not intended as limitations, but are provided for the convenience of describing the present disclosure.

What is claimed is:

1. A continuous circulation sub comprising:

an elongated sub housing having a first end and a second end and characterized by a wall defining a sub interior and at least one inlet flow port disposed in said wall, wherein the sub housing has an internal flow path formed in the interior therein between the first and second ends;

a sleeve disposed at least partially in the interior of the sub housing, the sleeve having a sleeve wall, wherein the sleeve is axially movable within the sub housing from a closed position to an open position, such that the sleeve wall substantially impedes fluid flow from the housing inlet flow port to internal flow path when the sleeve is in the closed position and wherein the inlet flow port and the internal flow path are in fluid communication when the sleeve is in the open position;

wherein the sleeve has a pressure surface defined thereon so as to provide a surface area upon which a first fluid pressure may act to urge the sleeve from the closed position to the open position;

a biasing member, wherein the biasing member urges the valve sleeve to the closed position by exertion of a biasing force on the sleeve; and a valve engaged by the sleeve, the valve disposed along the internal flow path, wherein the valve is movable by the sleeve between a first valve position so as to permit flow through the flow path between said first and second ends of the sub housing and a second valve position inhibiting flow through the flow path between said first and second ends of the sub housing, wherein the valve is in the first valve position when the sleeve is in the closed position and the valve is in the second valve position when the sleeve is in the open position.

2. The sub of claim 1, wherein said valve is a ball valve.

3. The sub of claim 1, wherein said valve is a flapper valve.

4. The sub of claim 1, further comprising a pressure port extending through said wall and in fluid communication with said pressure surface.

5. The sub of claim 4, further comprising a pressure chamber defined in the sub, wherein the pressure surface of said sleeve is disposed in said pressure chamber and said pressure port is in fluid communication with said chamber.

6. The sub of claim 5, wherein said pressure surface comprises a first side and a second side, wherein said pressure port is in fluid communication with the first side of said pressure surface and, said sub further comprising a vent port in fluid communication with the second side of said pressure surface.

7. The sub of claim 6, wherein said biasing member is disposed in said in said chamber adjacent the vent port and against said second side of said pressure surface.

8. The sub of claim 1, wherein said biasing member is a spring.

9. A continuous circulation system for a drill string, said system comprising:

at least one section of drilling pipe having an upper end and a lower end;

a first drilling fluid supply line attached to the upper end of said drilling pipe section and in fluid communication with said drilling pipe section;

a continuous circulation sub attached to the lower end of said drilling pipe section, said continuous circulation sub comprising an elongated housing having a first end and a second end and an exterior surface and characterized by a wall defining a sub interior, said sub having at least one inlet flow port disposed in said wall and in fluid communication with an internal flow path formed in the interior of said housing between the first and second ends;

a clamping assembly comprising a collar having a wall defining an interior surface with an elongated fluid flow channel formed along at least a portion of the interior surface of the collar and a flow port defined in the wall and in fluid communication with the channel, said clamping assembly radially disposed around at least a portion of the perimeter of the exterior surface of the sub so that said clamping assembly fluid flow channel is in fluid communication with said sub inlet flow port; and a second drilling fluid supply line in fluid communication with said clamping assembly flow port.

10. The system of claim 9, further comprising a drilling fluid reservoir in fluid communication with said first and second drilling fluid supply lines.

11. The system of claim 10, further comprising a first return line in fluid communication with said reservoir and a second return line in fluid communication with said reservoir.

12. The system of claim 11, further comprising a valve disposed in each of the first and second supply lines and each of the first and second return lines, wherein each valve is movable between a first position where it is open and a second position where it is fully closed, said primary supply line further comprising a manifold having a drilling fluid inlet, first outlet in fluid communication with said first supply line and a second outlet in fluid communication with said second supply line, said system further comprising a first manifold valve between said drilling fluid inlet and said first outlet and a second manifold valve between said drilling fluid inlet and said second outlet.

13. The system of claim 10, further comprising a primary supply line in fluid communication with said first and second supply lines and said reservoir, a first return line in fluid communication with said reservoir and said first supply line and a second return line in fluid communication with said reservoir and said second supply line.

14. The system of claim 9, wherein each supply line includes a valve disposed therein, wherein each valve is movable between a first position where it is open and a second position where it is fully closed, wherein one of said valves is in the first position when the other valve is in the second position.

15. The system of claim 9, wherein said clamping assembly are tongs.

16. The system of claim 9, wherein said continuous circulating sub further comprises a pressure port, said system further comprising a pressure source in fluid communication with said pressure port.

17. The system of claim 16, wherein said pressure source is a drilling fluid reservoir.

18. The system of claim 9, wherein said continuous circulating sub further comprises a pressure port, wherein said clamping assembly flow port is in fluid communication with said pressure port.

19. The system of claim 9, wherein said sub further comprises a first valve disposed in the internal flow path and a second valve disposed between the inlet flow port and the internal flow path.

20. The system of claim 19, wherein the first valve comprises a ball valve and the second valve comprises an axially movable sleeve slidably mounted in said sub interior.

21. A method of drilling a borehole that allows for continuous circulation of drilling fluid while making a drill string connection, comprising:

connecting a first continuous circulation sub to the top of a drilling tubular;

circulating drilling fluid through the top of the first continuous circulation sub while rotating the drilling tubular;

stopping rotation of the drilling tubular and setting slips to hold the drill string;

connecting a circulation device to the first continuous circulation sub without stopping circulation of drilling fluid through the top of the first continuous circulation sub by forming an elongated flow channel around a portion of the exterior circumference of the continuous circulating sub;

circulating drilling fluid through the first continuous circulation sub via the flow channel of the circulation device;

stopping circulation through the top of the first continuous circulation sub while continuing to circulate through the first continuous circulation sub via the circulation device;

connecting an additional drilling tubular to the top of the first continuous circulation sub with a second continuous circulation sub connected to the top of the additional drilling tubular;

circulating drilling fluid through the top of the second continuous circulation sub and stopping circulating fluid through the first continuous circulation sub; and resuming rotating the drilling tubular.

22. The method of claim 21, wherein circulating drilling fluid through the first continuous circulation sub via the circulation device further comprises closing a first valve in the first continuous circulation sub and opening a second valve in the first continuous circulation sub.

23. The method of claim 22, wherein circulating drilling fluid through the first continuous circulation sub via the circulation device further comprises closing a first valve in a drilling fluid manifold and opening a second valve in the drilling fluid manifold to reduce drilling fluid pressure in a drilling fluid line to the top of the first continuous circulation sub.

24. The method of claim 21, wherein circulating drilling fluid through the top of the second continuous circulation sub and stop circulating fluid through the first continuous circulation sub via the circulation device further comprises closing the first valve in the first continuous circulation sub and opening the second valve in the first continuous circulation sub.

25. A method for maintaining continuous flow through a drillstring during drill pipe connection, said method comprising:

establishing drilling fluid flow axially through the length of a tubular sub attached to the top of a drill string;

engaging said sub with a collar disposed at least partially around the perimeter of said sub by forming an elongated flow channel around a portion of the exterior circumference of the sub so as to define an exterior flow path along the exterior of said sub;

initiating radial flow into said sub through said collar and along said exterior flow path;

terminating axial flow through the length of the tubular sub while maintaining radial flow into said sub;

attaching a pipe joint to the top of the tubular sub;

reestablishing axial flow through the length of the tubular sub;

terminating radial flow into said sub; and disengaging said collar from said sub.

26. The method of claim 25, wherein radial flow into said sub is via a plurality of flow ports provided around the perimeter of said sub.

27. A method of drilling a borehole that allows for continuous circulation of drilling fluid while making a drill string connection, comprising:

connecting a first continuous circulation sub to the top of a drilling tubular;

circulating drilling fluid along an internal flow path formed in the interior of the sub between first and second ends while rotating the drilling tubular;

stopping rotation of the drilling tubular and setting slips to hold the drill string;

connecting a circulation device to the first continuous circulation sub without stopping circulation of drilling fluid along the internal flow path of the first continuous circulation sub;

circulating drilling fluid through the first continuous circulation sub via the circulation device, wherein the circulating drilling fluid moves a sleeve within the continuous circulating sub from a closed position to an open position and wherein the sleeve actuates a valve within the continuous circulating sub disposed along the flow path;

utilizing the actuated valve to impede circulation along the flow path from the first end to the second end of the sub while continuing to circulate through the first continuous circulation sub via the circulation device;

connecting an additional drilling tubular to the top of the first continuous circulation sub with a second continuous circulation sub connected to the top of the additional drilling tubular;

circulating drilling fluid through the top of the second continuous circulation sub and stopping circulating fluid through the first continuous circulation sub; and resuming rotating the drilling tubular.

28. The method of claim 27, wherein movement of the sleeve from the closed position to the open position establishes fluid communication between the circulation device and the internal flow path of the sub.

29. The method of claim 27 or 28, wherein movement of the sleeve from the closed position to the open position actuates the valve from an open position permitting flow through the valve to a closed position in which flow along the internal flow path through the valve is blocked.

30. A continuous circulation system for a drill string, said system comprising:

at least one section of drilling pipe having an upper end and a lower end;

a first drilling fluid supply line attached to the upper end of said drilling pipe section and in fluid communication with said drilling pipe section;

a continuous circulation sub attached to the lower end of said drilling pipe section, said continuous circulation sub comprising an elongated housing having a first end and a second end and an exterior surface and characterized by a wall defining a sub interior, said sub having at least one inlet flow port disposed in said wall and in fluid communication with an internal flow path formed in the interior of said housing between the first and second ends and a sleeve having a pressure surface, the sleeve disposed at least partially in the interior of the sub housing, wherein the sleeve is axially movable within the sub housing from a closed position to an open position;

a clamping assembly having a flow port defined therein, said clamping assembly radially disposed around at least a portion of the perimeter of the exterior surface of the sub so that said clamping assembly flow port is in fluid communication with said sub inlet flow port and said pressure surface of the sleeve; and a second drilling fluid supply line in fluid communication with said clamping assembly flow port.

31. The system of claim 30, wherein the clamping assembly comprises a collar having a wall defining an interior surface with an elongated fluid flow channel formed along at least a portion of the interior surface of the collar and the flow port defined in the wall and in fluid communication with the channel, said clamping assembly radially disposed around at least a portion of the perimeter of the exterior surface of the sub so that said clamping assembly fluid flow channel is in fluid communication said sub inlet flow port and said pressure surface of the sleeve.

* * * * *